United States Patent [19]

Mose et al.

[11] 4,196,069

[45] Apr. 1, 1980

[54] MEANS FOR DISTRIBUTING ELECTROLYTE INTO ELECTROLYTIC CELLS

[75] Inventors: Luciano Mose, Dortmund; Helmut Schurig, Holzwickede; Bernd Strasser, Hamm, all of Fed. Rep. of Germany

[73] Assignee: Hooker Chemicals & Plastics Corp., Niagara Falls, N.Y.

[21] Appl. No.: 39,996

[22] Filed: May 17, 1979

[30] Foreign Application Priority Data

May 19, 1978 [DE] Fed. Rep. of Germany ..... 2821980

[51] Int. Cl.[2] ..... C25B 15/08; C25B 9/00

[52] U.S. Cl. ..... 204/257; 204/263; 204/269; 204/275

[58] Field of Search ..... 204/257–258, 204/263–266, 269, 275

[56] References Cited

U.S. PATENT DOCUMENTS

| | | | |
|---|---|---|---|
| 1,335,338 | 3/1920 | Jenkins | 204/257 |
| 2,689,826 | 9/1954 | Kollsman | 204/257 X |
| 3,962,065 | 6/1976 | Scoville | 204/257 X |
| 4,031,001 | 6/1977 | Bosa | 204/257 |
| 4,069,129 | 1/1978 | Sato et al. | 204/257 X |

*Primary Examiner*—John H. Mack
*Assistant Examiner*—D. R. Valentine
*Attorney, Agent, or Firm*—Peter F. Casella; Howard M. Ellis

[57] ABSTRACT

The present invention provides an electrolyte feed system for feeding an individual supply of electrolyte to electrolytic cells in a filter press cell circuit. The system includes a primary electrolyte feed line, having one closed end and a plurality of outlets, or orifices, therein spaced along the length of the line. The primary feed line is encased in a larger, secondary feed line. The secondary feed line has a plurality of outlets, or orifices, therein spaced along its length corresponding to the outlets in the primary feed line. In a preferred embodiment, the feed lines are circular in cross-section and are in the form of pipes or tubes. The outlets in the primary and secondary feed lines are spacedly aligned, and the outlets in the secondary feed line are communicatively connected with the electrolyte inlets in the cell compartments of the individual cells in the cell circuit. Preferably, the outlets in the secondary feed line and the inlets in the cell compartments are approximately the same size and the outlets in the primary feed line are substantially smaller.

In operation, a supply of electrolyte enters the system through the primary feed line and initially fills both the primary feed line and the secondary feed line. The incoming electrolyte is jetted through the smaller outlets of the primary feed line, through the internal space between the primary and secondary feed lines, through the outlets in the secondary feed line and into the electrolyte compartments. The relatively small openings of the outlets in the primary feed line minimize the adverse effect that a drop in pressure in the electrolytic source line would have on the electrolyte level in the electrolyte in the electrolyte compartment of the cell circuit. If the outlets in the primary feed line do become clogged, the electrolyte compartments receive a supply of electrolyte from the secondary feed line.

6 Claims, 4 Drawing Figures

MEANS FOR DISTRIBUTING ELECTROLYTE INTO ELECTROLYTIC CELLS

BACKGROUND OF THE INVENTION

The present invention relates to an improved means for distributing electrolyte into electrolytic cells, particularly electrolytic cells assembled as units of a filter press cell arrangement. Electrolytic cells are particularly useful in the electrolysis of alkali metal chlorides, such as sodium chloride, to produce alkali metal hydroxides, such as sodium hydroxide, together with chlorine and hydrogen.

A filter press arrangement typically consists of a plurality of separate cell units having planar electrode elements generally mounted in a vertical position separated along their active faces by a barrier, such as a diaphragm or membrane layer. The filter press cell units may be monopolar or bipolar and may be appropriately connected in series or parallel to form a cell circuit or bank.

Chlorine and alkali metal hydroxides are essential and large volume commodities as basic industrial chemicals. Plants producing 500 to 1000 tons of chlorine per day are not uncommon. Such plants typically utilize a large number of individual electrolytic cells having current capacities of several hundred thousand amperes. Thus, minor improvements in individual cell operation or performance have major economic benefits because of the volume of the products produced.

Upon the application of direct, electrolyzing current to an electrolytic cell containing an aqueous solution of an alkali metal chloride as the electrolyte, hydrogen and alkali metal hydroxide are produced at the cathode and chlorine is produced at the anode.

Electrolytic cells that are commonly employed commerically for the conversion of alkali metal halides into alkali metal hydroxides and halides may be considered to fall into the following general types: (1) diaphragm, (2) mercury and (3) membrane cells.

Diaphragm cells utilize one or more diaphragms permeable to the flow of electrolyte solution but impervious to the flow of gas bubbles. The diaphragm separates the cell into two or more compartments. Although diaphragm cells achieve relatively high product per unit floor space, at low energy requirements and at generally high current efficiency, the alkali metal hydroxide product, or cell liquor, must be concentrated and purified. Such concentration and purification is usually accomplished by a subsequent evaporation step.

Mercury cells typically utilize a moving or flowing bed of mercury as the cathode and produce an alkali metal amalgam in the mercury cathode. Halide gas is produced at the anode. The amalgam is withdrawn from the cell and treated with water to produce a high purity alkali metal hydroxide.

Membrane cells utilize one or more membranes or barriers separating the catholyte and the anolyte compartments. The membranes are permselective, that is, they are selectively permeable to either anions and cations. Generally, the permselective membranes utilized are cationically permselective. Usually, the catholyte product of the membrane cell is a relatively high purity alkali metal hydroxide ranging in concentration between about 250 to about 350 grams per liter.

The introduction of dimensionally stable anodes has permitted ever narrowing of the space, or gap, between the electrodes of a cell, thereby facilitating progressively higher cell efficiency. The advent of dimensionally stable anodes and suitable membrane materials has made possible the construction of electrolytic cells having a thin separating partition positioned between planar electrodes, and the combination of a number of individual cell units, usually between about 10 and about 100, to form a cell circuit or bank arranged in the manner of a filter press. Circuits or banks of filter press cells are formed by the assembly of individual cell components. For example, in the case of a monopolar arrangement, the components typically would comprise a plurality of anodes mounted in anode frames and cathodes mounted in cathode frames. The anodes and cathodes are separated along their active faces by a permeable barrier, such as a diaphragm or membrane, and along the inner periphery of the frames by a pliable or elastic gasket member. The assembly is completed by coupling or pressing the components together, hydraulically or by means of threaded connectors, to compress the gasket members to form gas and liquid-tight seals between the individual cell chambers or units.

In a typical electrolysis operation employing an circuit of filter press cells to electrolyze sodium chloride, an anolyte feed, an aqueous solution of brine containing between about 100 and about 310 grams per liter sodium chloride, is introduced into each of the anolyte compartments, and a catholyte, water or a recirculating solution of sodium hydroxide, is introduced into each of the catholyte compartments. When an electrolyzing source of direct current is imposed on the circuit, chlorine is formed at the anodes and is removed from the anolyte compartments through suitable vents or ports, along with a portion of the brine, and fed into a common collector conduit along with the anodic products from other cells in the circuit. Hydrogen and sodium hydroxide, formed by migration of hydroxyl ions through the barrier member, are removed from the catholyte compartments through suitable vents or ports and fed into a separate common collector conduit along with the cathodic products from other cells in the circuit.

Because of the narrow electrode gaps presently in use, the width of the electrolyte between the electrodes is small. In a filter press cell, the electrolyte may be envisioned as thin layers or sheets interposed between the electrodes. For efficient cell operation it is important that both the anolyte and catholyte compartments in each cell have adequate and substantially equal levels of electrolyte. It is imperative that each compartment be supplied with electrolyte to avoid damage to, or destruction of, the cell components. One problem encountered in filter press cell arrangements is that variations in the flow rate of the common or central electrolyte feed sources causes undesirable variations in the electrolyte levels in the cell compartments, especially if the flow rate in a common electrolyte source is lowered.

U.S. Pat. No. 4,031,001 teaches the use of individual nozzles in the feed inlet of each catholyte and anolyte compartment to minimize the effect of a pressure drop in the common catholyte or anolyte source. However, to obtain this desired effect, the required nozzle diameters are necessarily small and, as such, are prone to clogging by solid particles unavoidably entrained in the electrolyte solutions. Such clogging can lead to little or no electrolyte being fed into the electrolyte compartment and consequent damage or destruction of the cell.

The present invention provides a means of minimizing the effect of a pressure drop in the common electrolyte source and insures a supply of electrolyte to the electrolyte compartments.

GENERAL DESCRIPTION OF THE INVENTION

The present invention provides an electrolyte feed system for feeding an individual supply of electrolyte to electrolytic cells in a filter press cell circuit. The system comprises a primary electrolyte feed line which has a plurality of outlets, or orifices, therein spaced along the length of the line. The primary feed line has a closed end and an open end. The open end is adapted to receive a supply of electrolyte. The primary feed line is encased, or enclosed, in a larger secondary feed line. The secondary feed line has a pluarlity of outlets, or orifices, therein spaced along the length of the line corresponding to the outlets in the primary feed line. The secondary feed line has an open end which receives and is sealed around the primary feed line. In a preferred embodiment, the feed lines are circular in cross-section and are in the form of pipes or tubes. The feed lines are preferably positioned under a filter press electrolytic cell circuit and parallel to the longitudinal axis of the circuit. The circuit is comprised of a plurality of individual cell units, each unit having at least one electrolyte compartment. Typically, the cell units have an anolyte and a catholyte compartment. Each electrolyte compartment has at least one inlet therein for receiving electrolyte. The outlets in the primary and secondary feed lines are spacedly aligned and the outlets in the secondary feed line are communicatively connected with the electrolyte inlets in the cell compartments. Preferably, the outlets in the secondary feed line and the inlets in the cell compartments are approximately the same size, and the outlets in the primary feed line are substantially smaller than either.

In operation, a supply of electrolyte enters the system through the primary feed line and initially fills both the primary feed line and the secondary feed line. The incoming electrolyte is jetted through the smaller outlets of the primary feed line, through the internal space between the primary and secondary feed lines, through the outlets in the secondary feed line and into the electrolyte compartments. The relatively small openings of the outlets in the primary feed line minimize the adverse effect that a drop in pressure in the electrolyte source line would have on the electrolyte level in the electrolyte in the electrolyte compartments of the cell circuit. If the outlets in the primary feed line do become clogged, the electrolyte compartments receive a supply of electrolyte from the secondary feed line.

The present electrolyte feed system is equally adapted and useful for both anolyte and catholyte feed systems, and, in a preferred embodiment, the cell circuit employs separate anolyte and catholyte feed systems.

DETAILED DESCRIPTION OF THE INVENTION

The present invention will now be explained in greater detail by reference to the accompanying drawings. The drawings are illustrative of the present invention and are not to be construed as limiting the invention to the particular mode shown.

Figure 1:
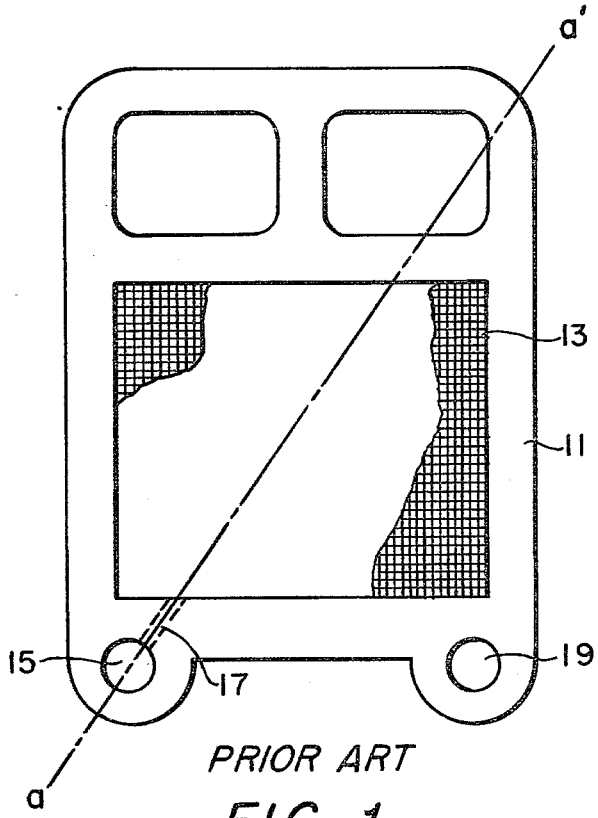
PRIOR ART FIG. 1
FIG. 1 is a frontal view of a typical anode or cathode frame unit in which the electrolyte feed conduits are part of the frame unit.

Looking now at FIG. 1, the electrode frame 11 has an electrode 13 mounted therein and is communicatively connected to electrolyte feed conduit 15 by inlet 17. In the case that electrode 13 is an anode, appropriate anolyte is fed through inlet 17 from a common source of anolyte from conduit 15 and appropriate catholyte flows through conduit 19. In the case that electrode 13 is a cathode, appropriate catholyte is fed through inlet 17 from a common source of catholyte from conduit 15 and appropriate anolyte flows through conduit 19. Anodes in anode frames and cathodes in cathode frames are arranged alternatively in a monopolar arrangement. If the circuit arrangement is bipolar, appropriate electrolyte inlets are located on either side of the single frame member. A barrier material, for example, asbestos or a membrane, is positioned between the frame members to separate the active faces of the individual electrodes. The frame members are assembled to form a plurality of individual cell chambers which are divided by the barrier material into anolyte and catholyte compartments. The cell circuit, comprised of a plurality of individual cell units, is shown in FIGS. 2 and 3 in schematic form.

Feed conduits 15 and 19 are the primary sources of anolyte or catholyte to the cell circuit, and the levels of electrolyte in the electrolyte compartments are directly responsive to a drip in the pressure in feed conduits. In accord with the present invention, feed conduits, such as 15 and 19, become secondary feed lines, minimizing the adverse effect of pressure drop in the electrolyte source.

Figure 2:
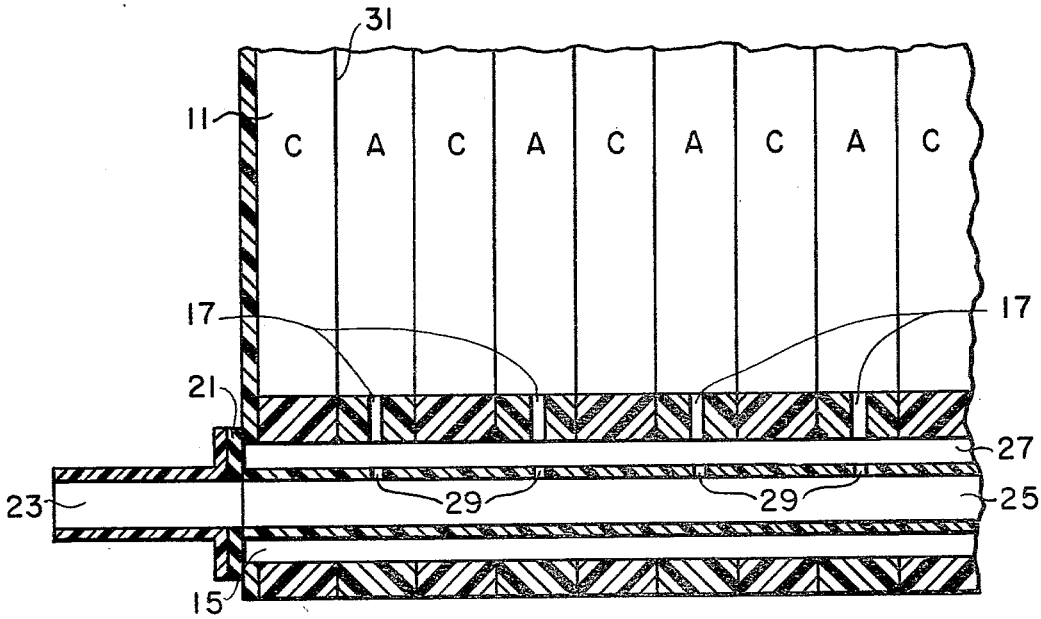
FIG. 2 is a partial, longitudinal sectional view of a filter press cell circuit comprised of frames, such as that shown in FIG. 1, which incorporates the present electrolyte distribution means.

FIG. 2 shows a partial cross-sectional view of a filter press cell circuit taken along plan a–a' of the frame member of FIG. 1. A supply of electrolyte flows through line 23 into primary feed line 25 positioned within secondary feed line 15. Electrolyte source line 23 is appropriately connected to primary feed line 25 through gasketed connection 21. Secondary feed line 15 may be closed at the opposite end of the cell circuit, or may be connected to a recycle line or utilized as a feed line to an additional cell circuit. Secondary feed line 15 is formed by the alignment of openings in individual frame members, such as 11, which are separated by barriers, shown schematically as 31, into electrolyte compartments, such as A and C. Primary feed line 25 is of a size to fit within secondary feed line 15 and leave space 27 between the outside of primary feed line 25 and the inside of secondary feed line 15. Primary feed line 25 is closed at its free end (not shown), and has a plurality of outlets, or openings, 29 corresponding to and aligned with inlets 17 of frames 11. Outlets 29 have an opening substantially smaller than the opening of inlets 17, preferably, the size ratio is in the range of from about 1 to 15. The electrolyte flow in primary feed line 25 passes through outlets 29, through space 27, inlets 17 and into electrolyte compartments A. The jet action of the electrolyte passing through outlets 29 of primary feed line 25 feeds electrolyte into cell compartments A. The liquid in space 27 minimizes the tendency of outlets 29 to clog. However, in case of clogging of outlets 29, compartments A are fed with a sufficient supply of electrolyte from the electrolyte in space 27 of secondary feed line 15 to avert an undesirable lack of electrolyte in the compartments.

Figure 3:
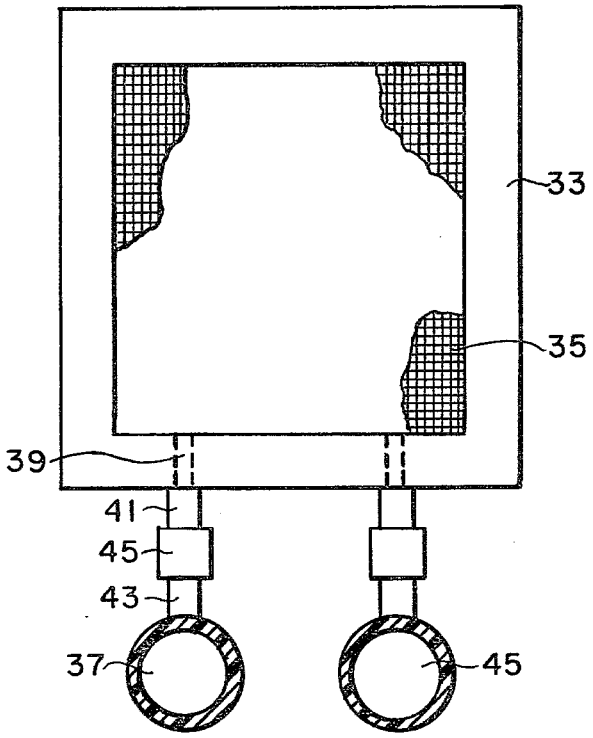
PRIOR ART FIG. 3
FIG. 3 is a frontal view of a typical anode or cathode frame unit in which the electrolyte feed conduits are separate from the unit.

FIG. 3 shows an electrode frame 33 having an electrode 35 mounted therein and communicatively connected to electrolyte feed conduit 37 by inlet 39, connections 41 and 43 suitably joined by a hose connection, such as 45. In case electrode 35 is an anode, appropriate anolyte is fed through inlet 39 from conduit 37, and an appropriate source of catholyte flows through feed conduit 47, bypassing the frame. In case electrode 35 is a cathode, appropriate catholyte is fed through inlet 39 from conduit 37, and appropriate anolyte flows through feed conduit 47. In accord with the present invention, feed lines, such as 37 and 47 become secondary feed lines.

Figure 4:
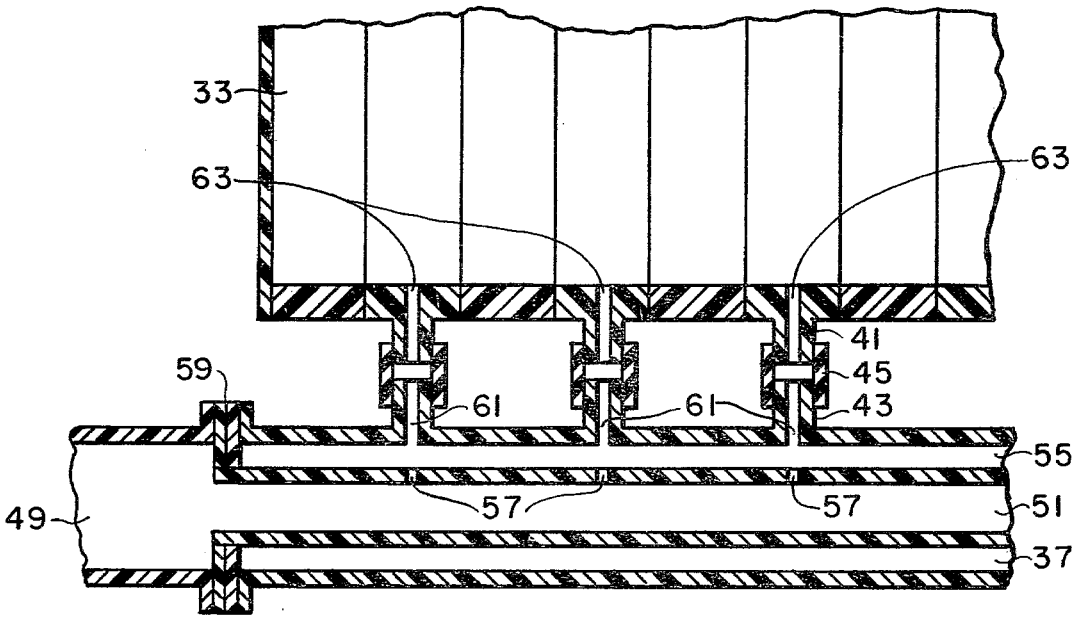
FIG. 4 is a partial, longitudinal sectional view of a filter press circuit comprised of frame and conduit units, such as that shown in FIG. 3, which incorporates the present distribution means.

FIG. 4 shows a partial cross-sectional view of a filter press electrolyte cell circuit comprised of electrode frames such as those shown in FIG. 2. A supply of electrolyte flows through source line 49 through connection 59 into primary feed line 51. Primary feed line 51 is positioned within secondary feed line 37. Lines 51 and 37 are preferably circular in cross-section and are coaxially positioned parallel to the longitudinal axis of the cell circuit. Primary feed line 51 is of a size to fit within secondary feed line 37 and leave annular space 55 therebetween. Primary feed line 51 has a closed end (not shown) and a plurality of outlets, such as 57, along its length. Secondary feed line 37 has a plurality of outlets, such as 61, along its length. Secondary feed line 37 sealably receives primary feed line 51 in one end and may be closed on the opposite end, or may be connected to an appropriate recycle line, or with an electrolyte source for a separate cell circuit. The outlets, such as 57, in primary feed line 51 are aligned with the outlets, such as 61 in secondary feed line 37 and with inlets, such as 63, in frames 33. Outlets, such as 57, in primary feed line 51 are substantially smaller than the outlets, such as 61, in secondary feed line 37 and the inlets, such as 63, in frames 33. Preferably, the ratio of the openings is in the range of about 1 to about 15.

Because operating space in cell room areas is usually at a premium, the primary feed line of the present invention is preferably fabricated of a flexible tube or hose, facilitating removal and replacement of the relatively long feed line by rolling or unrolling the line on a drum.

The materials of construction utilized to fabricate the present feed lines and cell frames are those materials which are temperature and corrosion-resistant under the conditions in which they are exposed and are generally known in the art. For example, titanium is useful in anolyte feed systems, and steel is useful in catholyte feed systems. Various resin materials are useful either as components, per se, or as coating for substrates, such as metals. For example, polypropylene, polybutylene, polytetrafluoroethylene, after chlorinated or rigid FEP, or chlorendic acid based polyesters are generally useful as components or as coating materials.

While there have been described various embodiments of the invention, the apparatus described is not intended to be understood as limiting the scope of the invention as it is realized that changes therewith are possible, and it is intended that each element recited in any of the following claims is to be understood as referring to all equivalent elements for accomplishing the same results in substantially the same or equivalent manner, it being intended to cover the invention broadly in whatever form its principle may be utilized.

What is claimed is:

1. An electrolyte feed system for feeding an individual supply of electrolyte to a plurality of electrolytic cells in a filter press cell circuit comprising:

(a) a primary feed line having a plurality of outlets spaced along the length thereof, said primary feed line having a closed end and an open end, said open end adapted to receive a supply of electrolyte, (b) a secondary feed line encasing said primary feed line and having a plurality of outlets spaced along the length thereof, said secondary feed line having at least one end sealably receiving said primary feed line, (c) a plurality of electrolytic cells, each cell having at least one electrolyte compartment and each compartment having at least one electrolyte inlet therein, (d) said outlets in said primary feed line spacedly aligned with the outlets in said secondary feed line and said outlets in said secondary feed line communicatively connected with said electrolyte inlets in said cell compartments, and (e) said outlets in said primary feed line being substantially smaller than the outlets in said secondary feed line and said inlets in said cell compartments.

2. The system of claim 1 wherein the size of the outlets in said primary feed line and in said secondary feed line are in a ratio of from about 1 and 15.

3. The system of claim 1 wherein the electrolyte is anolyte.

4. The system of claim 1 wherein the electrolyte is catholyte.

5. The system of claim 1 wherein the primary and secondary feed lines have circular cross-sections.

6. The system of claim 1 wherein the primary feed line is a flexible hose.

* * * * *